United States Patent [19]

Miller

[11] 4,126,367

[45] Nov. 21, 1978

[54] SEALED BATTERY CABLE ASSEMBLY

[75] Inventor: Gerald K. Miller, Hersey, Mich.

[73] Assignee: Nartron Corporation, Reed City, Mich.

[21] Appl. No.: 798,805

[22] Filed: May 20, 1977

[51] Int. Cl.[2] ..... H01R 7/08; H01R 11/12

[52] U.S. Cl. ..... 339/29 B; 339/116 C; 339/232; 339/277 R

[58] Field of Search ..... 339/28, 29, 19, 116, 339/224–240, 242, 275 T, 277, 276 T

[56] References Cited

U.S. PATENT DOCUMENTS

| | | | |
|---|---|---|---|
| 1,918,070 | 7/1933 | Watts | 339/28 |
| 2,338,524 | 1/1944 | McCabe | 339/29 R |
| 2,759,161 | 8/1956 | Berg | 339/275 T |
| 2,789,274 | 4/1957 | Zam | 339/116 C |
| 3,181,110 | 4/1965 | Waters | 339/277 R |
| 3,389,368 | 6/1968 | Schaefer | 339/116 C |
| 3,928,079 | 12/1975 | Jennings et al. | 339/116 R |
| 4,049,335 | 9/1977 | Julian et al. | 339/232 |

FOREIGN PATENT DOCUMENTS

| | | | |
|---|---|---|---|
| 128,143 | 6/1919 | United Kingdom | 339/276 T |

*Primary Examiner*—Neil Abrams
*Attorney, Agent, or Firm*—Lon H. Romanski

[57] ABSTRACT

A battery cable assembly is shown as having a conductor to which a plurality of plate-like terminals, spaced from each other, are operatively secured; substantially all of the cable assembly is sealed within a protective relatively resilient coating with provision being made for access to the plate-like terminals for connection thereof to the post-like terminals of related batteries.

5 Claims, 13 Drawing Figures

SEALED BATTERY CABLE ASSEMBLY

BACKGROUND OF THE INVENTION

In many instances, especially as in heavy on-road and off-road trucks and the like, it becomes necessary to electrically connect a plurality of storage batteries in either parallel or series (or even in combinations thereof) in order to obtain the desired current and/or voltage therefrom.

Heretofore, the prior art has employed, for example, a series of electrical cable segments with each such segment being provided with only two electrical terminals as to interconnect only two related terminals of either associated batteries or that of an associated battery and a related apparatus to be electrically connected to such battery. In such situations it was, and is, common practice to, in effect, stack the terminals of the cable segments (where two or more of such cable segments were to be connected to a common terminal of, for example, a battery). Among other drawbacks of such prior art arrangements, such segmented cables often become lost and/or damaged during the time that, for example, the batteries have to be changed or charged. Also, the stacking of the cable terminals upon or about the associated battery terminal or post often results in an inferior mechanical connection therebetween which, in turn, often results in unintentional disconnection of the cable segments brought about by the vibrations induced therein as from associated engine means and vehicle ground contact.

The prior art has also proposed employing a cable assembly having a first cable segment or portion which has its first end adapted for connection to apparatus to be connected to a battery, and its second end provided with a terminal for connection to a first post terminal of a first battery. A second cable segment or portion has its one end also provided with a terminal for connection to a first post terminal (of the same polarity as the said first battery) of a second battery, and has its other end mechanically spliced to the first cable portion at a point generally between the first and second ends thereof. It has been found that such a splice greatly reduces the mechanical strength of the cable assembly often resulting in a failure at that point both mechanically and electrically. Also, the splice presents a rather very large bulbous-like portion which also severely reduces the flexibility of the cable assembly, in that area, which, in turn, often causes problems in bending the cable assembly in order to avoid other apparatus as may be situated in close proximity thereto and, for example, within the engine compartment.

The prior art has also proposed forming a cable assembly which has a first relatively long cable portion which has its first end adapted for connection to apparatus to be connected to a battery, and its second end provided with a first terminal for connection to a first post terminal of a first battery. A second cable segment or portion has its one end also provided with a terminal for connection to a first post terminal (of the same polarity as the first battery) of a second battery, and has its other end mechanically and electrically connected to the said first terminal of the first cable portion. The manner in which such first terminal is connected to the first and second cable portions results in each of such cable portions extending from one side of the terminal body and, substantially parallel to each other thereby, in effect, making the second relatively shorter cable portion double-back on the first relatively longer cable portion. Consequently, there are always two cable portions bridging any two interconnected batteries. When, especially more than two batteries are interconnected, there is a profusion of bridging and crisscrossing cable segments or portions which leads to visual confusion especially when repair or other work has to be performed thereon in less than adequate light.

Accordingly, the invention as herein disclosed and claimed is primarily directed to the solution of the foregoing as well as other related and attendant problems.

SUMMARY OF THE INVENTION

According to the invention an electrical cable assembly for use in electrically interconnecting at least three electrical first terminals comprises elongated in-line electrical conductor means, at least three electrical second terminals electrically connected to said conductor means for respective electrical connection to said three electrical first terminals, said at least three electrical second terminals being mechanically connected to said conductor means and at least two of said at least three electrical second terminals being soldered to said conductor means, and additional sealing means enveloping at least a major portion of at least two of said at least three electrical second terminals.

Various general and specific objects and advantages of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figures 1, 2, 12, 13:
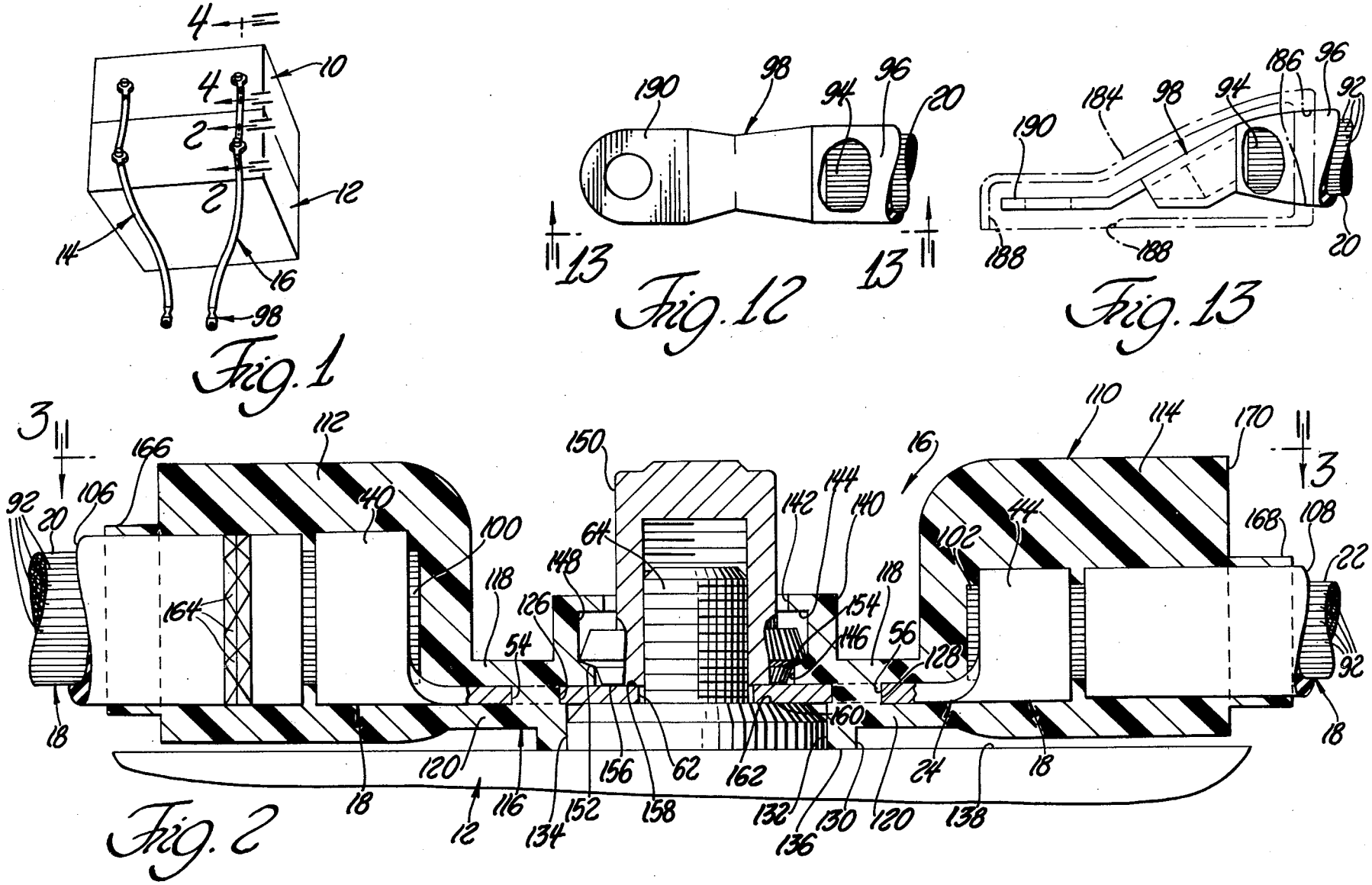
FIG. 1 is an isometric view of two storage type batteries electrically interconnected, in parallel, by cable means embodying teachings of the invention.
FIG. 2 is an enlarged longitudinal or axial cross-sectional view, of a fragmentary portion of one of the cable means of FIG. 1, taken generally on the plane of line 2—2 of FIG. 1 and looking in the direction of the arrows.
FIG. 12 is an enlarged top plan view of one end of one of the cable means of FIG. 1 and rotated approximately 90° from the position shown in FIG. 1.
FIG. 13 is a side elevational view taken generally on the plane of line 13—13 of FIG. 12 and looking in the direction of the arrows.

Referring now in greater detail to the drawings, FIG. 1 illustrates, by way of example, two storage batteries 10 and 12 with their respective negative post terminals mechanically and electrically connected to first cable means 14 and their respective positive post terminals mechanically and electrically connected to second cable means 16 with each of said cable means 14 and 16 being constructed as to embody teachings of the invention. For purposes of consideration of the invention in greater detail, only cable means 16 will be considered since such cable means 14 and 16 may be identical to each other. Further, even though the invention is illustrated in an embodiment for accommodating two batteries, as the description of the invention progresses, it will become apparent that the invention may equally well be practical in a configuration accommodating three, four or any number of batteries to be connected to each other, as well as serve as a bus bar type cable assembly for supplying electrical energy to a number of electrical energy consuming associated apparatus.

Figure 6:
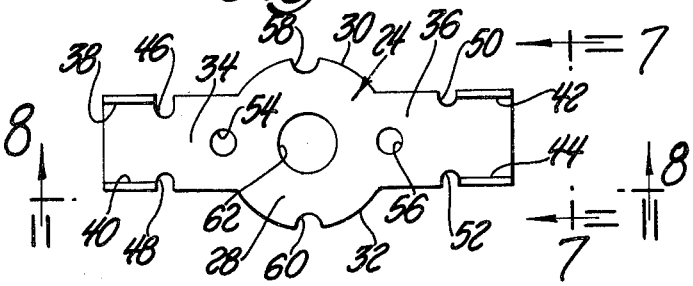
FIG. 6 is a top plan view of one of the terminal means employable in the invention.
Figure 7:
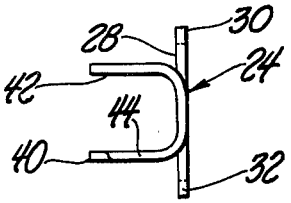
FIG. 7 and 8 are respectively elevational views taken on the planes of lines 7—7 and 8—8 of FIG. 6 and looking in the direction of the arrows.
Figure 8:
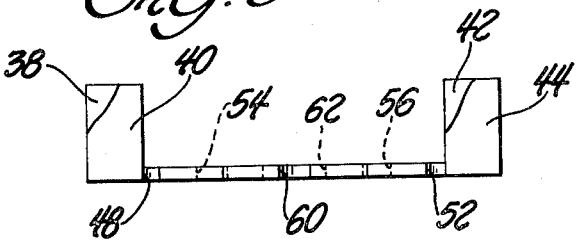

As can best be seen in FIGS. 2, 3, 4 and 5 the invention comprises conductor means 18 which comprises cable conductor means or portions 20 and 22 and cable terminal means 24 and 26. As shown in FIGS. 6, 7 and 8, terminal 24, which in the preferred embodiment is formed of brass, is a double-ended type having a main plate-like body portion 28, which may have peripheral arcuate portions 30 and 32, integrally formed with oppositely disposed generally coplanar radiating arms 34 and 36 which, in turn, are respectively provided with tab portions 38, 40 and 42, 44. In the preferred embodiment, arms 34 and 36 are provided with relieved or cut-out portions 46, 48, 50 and 52 which both localize and enhance the bending-over or curling of tabs 38, 40 and 42, 44 during fabrication of the cable assembly 16. Further, in the preferred embodiment, terminal means 24 is provided with apertures 54 and 56 as well as notch-like recesses or relieved portions 58 and 60. As will become apparent, such recesses and apertures 58, 60, 54 and 56 provide for enhancing the mechanical connection of the terminal 24 into the overall cable assembly 16 as well as to better assure its proper relative position. An aperture 62, formed through body 28 generally centrally thereof, permits the insertion therethrough of a coacting battery terminal post as depicted at 64 of FIG. 2.

Figure 9:
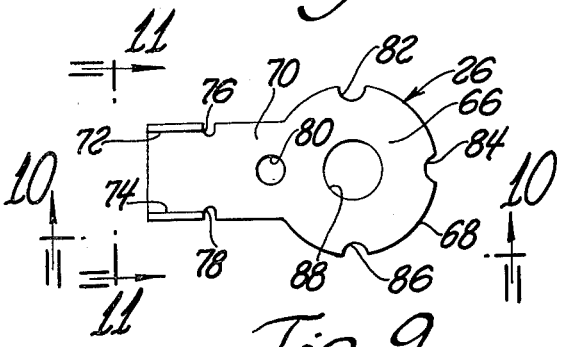
FIG. 9 is a top plan view of an other of the terminal means employable in the invention.
Figure 10:
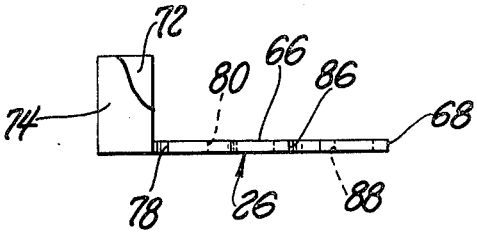
FIGS. 10 and 11 are respectively elevational views taken on the planes of lines 10—10 and 11—11 of FIG. 9 and looking in the direction of the arrows.
Figure 11:
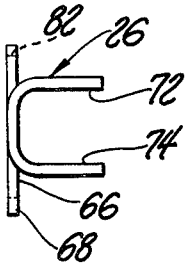

Similarly, FIG. 9, 10 and 11 illustrate terminal 26, which in the preferred embodiment is formed of brass, as being a single-ended type having a main body portion 66, which may have a peripheral arcuate portion 68, integrally formed with a generally coplanar radiating arm 70 which, in turn, is provided with tab portions 72 and 74. In the preferred embodiment, arm 70 is provided with relieved or cut-out portions 76 and 78 which both localize and enhance the bending-over or curling of tabs 72 and 74 during fabrication of the cable assembly 16. Also, aperture means 80 and notch-like recesses or relieved portions 82, 84 and 86 are preferably provided for enhancing the mechanical connection of the terminal 26 into the overall cable assembly 16 as well as to better assure its proper relative position. An aperture 88, formed through body 66 generally centrally thereof, permits the insertion therethrough of a coacting battery terminal post as depicted at 90 of FIG. 4.

Figure 3:
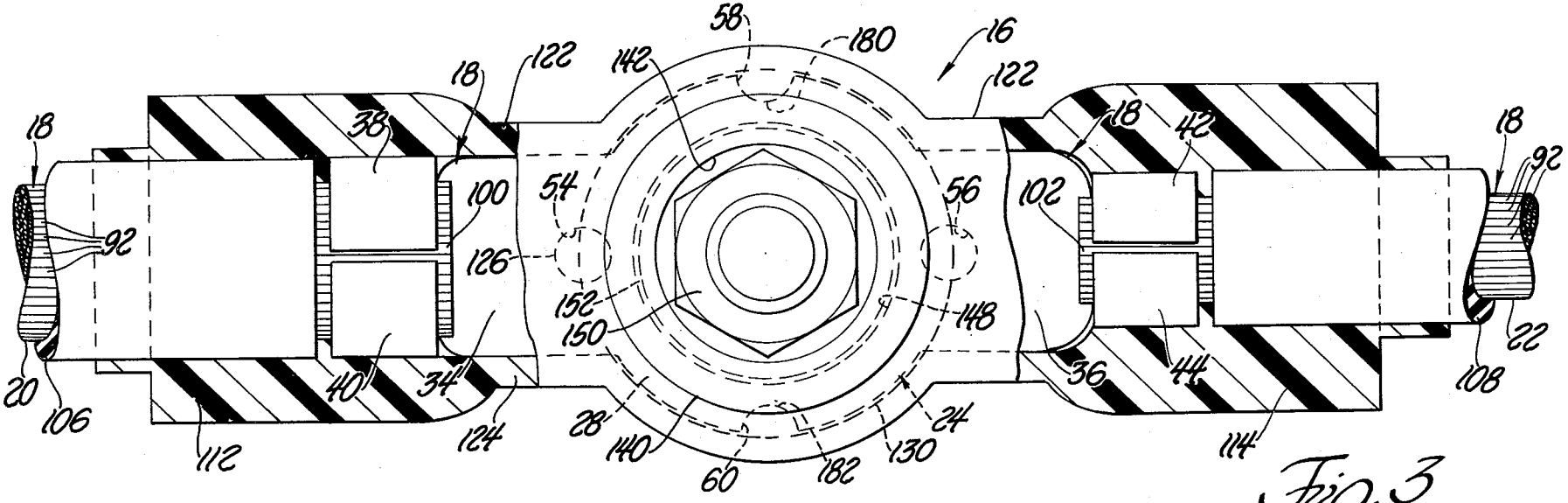
FIG. 3 is a top plan view taken generally on the plane of line 3—3 of FIG. 2 and looking in the direction of the arrows, with certain portions broken away and in cross-section.

As can be seen, preferably both cable portions 20 and 22 are each comprised of a plurality of wire-like strands 92 of electrical conductors situated either in parallel or twisted configuration with respect to each other. As can be seen in FIGS. 12 and 13, a first end 94 of cable portion 20 is suitably secured within the generally cupped or curled end 96 of a bracket-like terminal 98. Preferably, such end 94 is not only mechanically crimped by the end 96 of terminal 98 but is also soldered therein and thereto. The other end 100 of cable portion 20, as shown in FIGS. 2 and 3, is mechanically and electrically connected to terminal 24 as by being crimped and contained by the coacting tabs 38 and 40 bent thereabout and thereagainst. Similarly, end 102 of cable portion 22 is mechanically and electrically connected to the same terminal 24 as by being crimped and contained by the coacting tabs 42 and 44 bent thereabout and thereagainst. The other end 104 of cable portion 22 is similarly mechanically and electrically connected to the next or end terminal 26 as by being crimped and contained by the coacting tabs 72 and 74 bent thereabout and thereagainst.

The following steps are employed in the production and/or construction of the invention. That is, cable portions 20 and 22 are selected as to have a desired current carrying capacity and desired respective lengths. Such cable portions if already provided with an electrically insulating coating or cover 106 and 108, have portions of such coatings (which may be a relatively resilient thermoplastic material such as, for example, neoprene or polyvinyl chloride) stripped or otherwise removed as from the ends 94 and 100 of cable portion 20 and ends 102 and 104 of cable portion 22. End 94 is placed within the open end 96 of bracket-like terminal, ends 100 and 102 are respectively placed within the open tabs 38, 40 and 42, 44 while end 104 is placed within open tabs 72 and 74. All of such tabs are mechanically crimped against the respective cable ends contained therebetween and end 96 is similarly crimped against end 94 of cable 20. All of the terminals thusly secured to the cable portions are thereafter dipped into and coated within a silver solder bath in a manner whereby such coating also occurs at each connection between a terminal and a coacting end of the related cable as well as to coat the entirety of each terminal. This enchances both the mechanical strength and the electrical conductivity therebetween. Such a mechanically connected and soldered cable structure then has additional sealing and connecting means formed thereon as by molding.

With reference to FIGS. 2 and 3 it can be seen that a first seal or joint-like structure 110 is formed generally on and about the terminal 24. That is, the sealing means 110, as illustrated, may be comprised of a first relatively enlarged body portion 112 which totally circumferentially envelopes a substantial portion of cable portion 20, including a portion of the coating 106, as well as the end 100 of cable 20 and the crimped tabs 38 and 40. The means 110 further comprises a second relatively enlarged body portion 114 which similarly totally circumferentially envelopes a substantial portion of cable means 22, including a portion of the coating 108, as well as the end 102 of cable 22 and the crimped tabs 42 and 44.

As is also shown in FIGS. 2 and 3, bodies 112 and 114 are integrally formed with a bridging portion 116 which effectively envelopes the arms 34 and 36 as well as the plate-like body 28 of terminal 24. As can be seen in FIG. 2, the bridging portion 116 is comprised of an upper layer 118, situated atop arms 34, 36 and body 28, and a lower layer 120 situated immediately below arms 34, 36 and body 28. Such layers 118 and 120 are integrally joined to each other as by side portions 122 and 124 (FIG. 3) disposed generally along opposite side edges of the terminal 24, and by additional portions 126, 128 respectively passing through apertures 54 and 56.

The lower layer 120 is provided with an integrally formed generally downwardly depending tubular portion 130 which has an inner diameter 132 of a size preferably to closely receive therein a terminal base 134 which is often provided in the usual commercially available storage battery configuration. In such an arrangement, the related battery post terminal 64 is integrally formed with or otherwise made a functional part of the terminal base 134. In the preferred embodiment, the axial length of the tubular extension is made sufficiently long as to assure the free end 136 thereof to bear against the juxtaposed surface 138 of the related battery when the terminal 24 is secured to the battery post terminal.

The upper layer 118 of the bridging portion 116 is also provided with a generally upwardly directed integrally formed tubular portion 140. The upper end of the tubular extension 140 is provided with a transverse wall portion through which an aperture 142 is formed thereby defining a generally radially inwardly directed annular flange-like portion 144.

The lower or inner end of the tubular extension 140 is provided with an integrally formed ring-like or annular seat 146, extending radially inwardly, which, in FIG. 2 is shown in a somewhat resiliently compressed or deflected condition. The inner diameter 148 of tubular extension 140 is of a size sufficient to permit the rotary and axial downward movement therein of a related securing nut 150. As can be seen, the nut 150 is internally threaded, as to threadably coact with the post terminal 64, and provided with a radially outwardly directed annular flange 152. Accordingly, as the nut 150 is threaded downwardly onto post terminal 64 flange 152 engages surface 154 of flange 146 so that further downward movement of nut 150 results in an increasing resilient deflection of such surface 154 and flange 146 until such time as end 156 of nut 150 abuts against upper surface 158 of terminal body 28 causing the lower surface 160 thereof to be tightly pressed and seated against the upper annular surface 162 of terminal base 134. Even though not necessary to the practice of the invention, the insulating covering material, near the ends of the cables joined to the terminals, may be scored or otherwise formed or provided with an uneven surface, as generally depicted at 164, in order to enhance the bonding quality as between, for example, the covering 106 and the related molded body 112. Further, even though in the preferred embodiment it is desired that an actual fused bond be achieved as between the interior of the bodies 112, 114 and outer insulating covers 106, 108, such is not essential to the practice of the invention.

Also, in the preferred embodiment of the invention, sleeve like extensions 166 and 168 are respectively integrally formed with bodies 112 and 114 in a manner as to extend a substantial axial distance along the respective cable means 20 and 22. As can be seen, the tubular extensions 166, 168, also molded against the outer covering of cable means 20 and 22, are only slightly larger, in outer diameter, than the related cable means while being significantly smaller than the respective bodies 112, 114 with which they are integrally formed. The provision of such tubular extensions results in a very important benefit, regardless of the particular configuration of the remaining structure. That is, it has been discovered that where any cable assembly in made as to have a molded sealing means (equivalent to, for example, means 110) which is molded to the outer covering of a related cable or wire, and if such is later subjected to bending or flexing that the quality of the seal as between the said sealing means and said outer covering tends to relatively quickly deteriorate causing the said outer covering to, in effect, pull away from the enveloping seal means. This is believed to be brought about by the coated cable or wire in effect bending about a rather sharp corner (such being determined as by the plane of an end surface 170 intersecting the tubular trace of the coated cable or wire) thereby localizing mechanical stresses at a diametrically opposite point. It has been discovered that the addition of an integrally formed tubular extension (such as, for example, 168) for all practical purposes eliminates such a problem of separation. It is believed that this occurs because the said rather sharp corner is effectively eliminated and the bending stresses exhibited by the coated cable or wire are more uniformly spread along the tubular extension molded thereto. In any event, even though the reasons for the result may not be clearly understood or in fact may be incorrect, the unexpected end result has been discovered and, during testing, has shown to be consistently repeatable.

The seal means 110 may be formed of any suitable material such as, for example, polybutadiene, polybutene, PBC or any other suitable rubber-like material.

Figure 5:
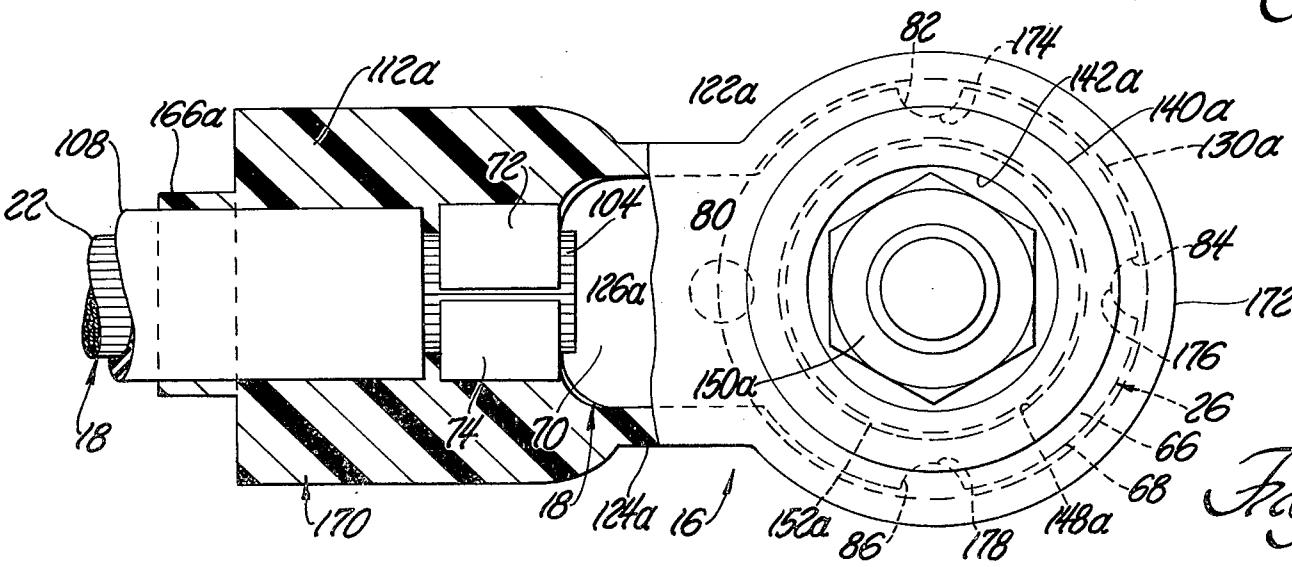
FIG. 5 is a top plan view taken generally on the plane of line 5—5 of FIG. 4 and looking in the direction of the arrows, with certain portions broken away and in cross-section.
Figure 4:
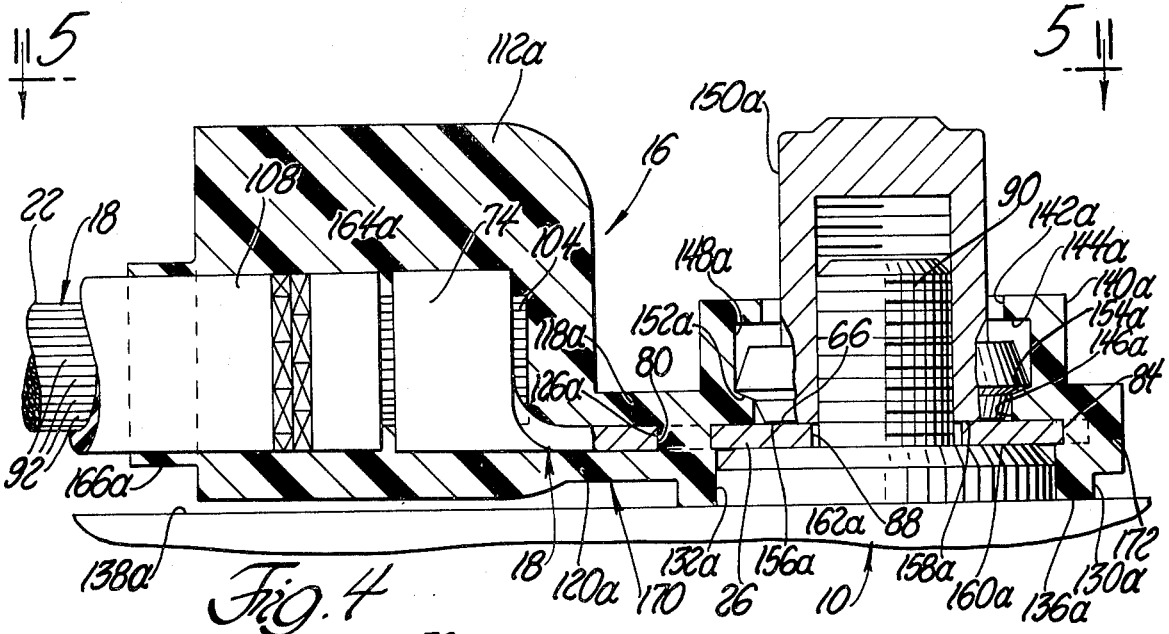
FIG. 4 is an enlarged longitudinal or axial cross-sectional view, of a fragmentary portion of one of the cable means of FIG. 1, taken generally on the plane of line 4—4 of FIG. 1 and looking in the direction of the arrows.

With reference to FIGS. 4 and 5, it can be seen that the end terminal 26 is provided with a seal means 171 similar to that of seal 110 of FIGS. 2 and 3 with the primary exception being that only a single main body is employed since the end terminal 26 is connected to only one cable portion 22. All elements of the seal means 171 and related securing means in FIGS. 4 and 5 which are like or similar to those of FIGS. 2 and 3 are identified with like reference numerals provided with a suffix "*a*." As can be seen, in FIGS. 4 and 5 there is no second body or portion of the sealing means which corresponds to body 114 (and associated elements) as shown in FIGS. 2 and 3. Instead, what would otherwise in FIGS. 2 and 3 be considered a bridging portion of the sealing means, now terminates in a generally circumferentially enveloping end 172 which blends into and is formed integrally with edge portions 122*a* and 124*a*. The upper and lower layers 118*a* and 120*a* are also joined to each other as by the portion 126*a* extending through aperture 80 and any relative rotational movement is further inhibited as by portions 174, 176 and 178 passing through notches 82, 84 and 86 similarly to portions 180 and 182 passing through notches 58 and 60 of terminal 24.

As generally depicted in FIG. 13, bracket-like terminal 98 may be provided with a slidable resiliently deflectable shoe-like cover 184 which, at one end has an aperture 186 permitting such to slide axially along the cable means 20, and a second downwardly directed open end 188 for permitting related structure to be fastened to the plate portion 190 of terminal 98.

As should be apparent, the invention provides an in-line cable assembly which in no way requires one cable or wire conductor to be spliced to another cable or wire conductor and which in no way requires that any portion of the cable assembly double-back upon itself during connection to associated battery means.

Also, another important benefit is that, for all practical purposes, the actual connection between the battery and a terminal of the cable is sealed from such dirt and moisture as otherwise often contacts such connections. For example, the downwardly projecting tubular extension effectively seals the base end of the battery terminal from any dirt in the vicinity while the coaction of the flange, as 152, with the seal ring 146 effectively stops the passage of dirt and moisture from above. Also, even though the flange 144 and upper tubular extension 140 are relatively resilient, they still serve to somewhat cage the flange 152 of nut 150 therein. Accordingly, in removing the cable assembly, especially at night with limited available light, the nut 150 is less apt to become lost since such nut can be threadably disengaged from the battery post terminal without the attendant necessity of removing the nut from its caged condition in the cable assembly.

Although only a preferred embodiment of the invention has been disclosed and described it is apparent that other embodiments and modifications of the invention are possible within the scope of the appended claims.

I claim:

1. An electrical cable assembly for use in electrically interconnecting at least three electrical first terminals of associated apparatus wherein at least one of said three terminals is a stud with an enlarged base-like shoulder portion, comprising elongated in-line electrical conductor means, a cover of electrically non-conductive relatively flexible material circumferentially covering the outer surface of said electrical conductor means and extending longitudinally therealong for at least a major portion thereof, at least three electrical second terminals electrically connected to said conductor means for respective electrical connection to said three electrical first terminals, said at least three electrical second terminals being mechanically connected to said conductor means, at least two of said at least three electrical second terminals being soldered to said conductor means, and additional sealing means enveloping at least a major portion of at least two of said at least three electrical second terminals, at least one of said at least two electrical second terminals comprises a non-tubular solid plate-like electrical conductor, said solid plate-like conductor comprising first and second mechanically formed retainer means tightly circumferentially engaging portions of said conductor means not covered by said cover, said sealing means being formed of relatively resilient material and enveloping said retainer means and said portions of said conductor means not covered by said cover, said solid plate-like conductor also comprising an aperture formed therethrough for the reception therein of said one of said electrical first terminals, said aperture being situated generally between said first and second retainer means, said in-line conductor means comprises a first longitudinally extending conductor section and a second longitudinally extending conductor section, said first retainer means being mechanically connected to a said portion of said conductor means not covered by said cover and at one end of said first conductor section and said second retainer means being mechanically connected to another said portion of said conductor means not covered by said cover and at one end of said second conductor section, said sealing means further comprising a generally downwardly depending pilot-like portion for receiving therewithin a portion of said stud and at least a portion of said base-like shoulder portion, and a generally upwardly extending open-ended chamber-defining housing-like portion, said housing-like portion being effective for generally circumscribing said stud when said stud is received through said aperture.

2. An electrical cable assembly according to claim 1 wherein said downwardly depending and upwardly extending portions are operatively interconnected to each other by integrally formed joining means extending through cut-out portions formed in said solid plate-like conductor.

3. An electrical cable assembly according to claim 1 wherein said downwardly depending pilot-like portion is relatively resiliently deflectable and comprises a downwardly directed annular end surface disposed in juxtaposed relationship to a surface of associated apparatus supporting said stud and base-like shoulder portion when said non-tubular solid plate-like conductor is operatively connected to said stud.

4. An electrical cable assembly according to claim 1 wherein said upwardly extending portion is relatively resiliently deflectable and effective for sealingly engaging against associated fastener means employed for securing said solid plate-like conductor to said stud.

5. An electrical cable assembly according to claim 1 wherein said downwardly depending portion is relatively resiliently deflectable and effective for sealingly engaging against associated structure carrying said stud and base-like shoulder portion, and wherein said upwardly extending portion is relatively resiliently deflectable and effective for sealingly engaging against associated fastener means employed for securing said non-tubular solid plate-like conductor to said stud.

* * * * *